US008522854B2

(12) United States Patent
Lin

(10) Patent No.: US 8,522,854 B2
(45) Date of Patent: Sep. 3, 2013

(54) OPERATING DEVICE FOR ROTATING A WINDING ROLLER OF A WINDOW BLIND

(76) Inventor: Shih-Ming Lin, Chiayi Hsien (TW)

( * ) Notice: Subject to any disclaimer, the term of this patent is extended or adjusted under 35 U.S.C. 154(b) by 108 days.

(21) Appl. No.: 13/189,635

(22) Filed: Jul. 25, 2011

(65) Prior Publication Data

US 2013/0025805 A1 Jan. 31, 2013

(51) Int. Cl.
*A47G 5/02* (2006.01)

(52) U.S. Cl.
USPC ..... 160/309; 160/178.1 R; 160/178.1 V

(58) Field of Classification Search
USPC ..... 160/178.1 R, 178.1 V, 176.1 R, 168.1 R, 160/173 R, 177 R, 309; 74/89.23; 81/DIG. 2
See application file for complete search history.

(56) References Cited

U.S. PATENT DOCUMENTS 386,328 A * 7/1888 Long ..... 160/309
407,842 A * 7/1889 Schuermann ..... 74/127
1,838,957 A * 12/1931 Orawiec ..... 74/127
2,455,434 A * 12/1948 Mikelson ..... 74/127
4,759,398 A * 7/1988 Renee ..... 160/178.1 R
5,476,132 A * 12/1995 Jacobson ..... 160/168.1 V
5,787,953 A * 8/1998 Jacobson ..... 160/168.1 R
6,044,890 A * 4/2000 Renee ..... 160/177 R
6,089,303 A * 7/2000 Metcalf et al. ..... 160/176.1 R
6,298,897 B1 * 10/2001 Metcalf et al. ..... 160/177 R
8,205,658 B1 * 6/2012 Lin ..... 160/320
8,251,119 B2 * 8/2012 Toti et al. ..... 160/168.1 R

* cited by examiner

*Primary Examiner* — Blair M. Johnson
(74) *Attorney, Agent, or Firm* — Muncy, Geissler, Olds & Lowe, PLLC

(57) ABSTRACT

An operating device for rotating a winding roller of a window blind, includes an upright rotating shaft rotatable to cause rotation of the winding roller and having a thread segment, a sleeve shell movably surrounding the thread segment, a carrier disposed within the sleeve shell to be movable axially between pressed and non-pressed positions to hold a force transmitting member that is engaged with the thread segment, and a rotation preventing unit disposed between the sleeve shell and the carrier so as to transmit an axially manual force applied to the sleeve shell to move the carrier axially so as to rotate the rotating shaft through engagement of the force transmitting member with the thread segment in the pressed position, thereby winding up a window covering.

7 Claims, 6 Drawing Sheets

OPERATING DEVICE FOR ROTATING A WINDING ROLLER OF A WINDOW BLIND

BACKGROUND OF THE INVENTION

1. Field of the Invention

This invention relates to a window blind, more particularly to an operating device for rotating a winding roller of a window blind to wind up a window covering.

2. Description of the Related Art

A conventional window blind generally includes a winding roller, a window covering extending downwardly from the roller, and a ring chain (or cord) disposed on an end portion of the roller and extending downwardly. A user can pull the ring chain to rotate the winding roller such that the window covering can be raised or lowered. However, such ring chain poses choking or strangulation hazards to young children. Another window blind such as those disclosed in EP Application No. 10157918.3 and U.S. patent application Ser. No. 12/696,173, is provided with an operating rod to replace the ring chain. The operating rod extends vertically and has an upper end coupled with a winding roller by a rotation transmitting mechanism such that vertical rotation of the operating rod results in horizontal rotation of the winding roller, and a lower end coupled with a hinged handle which can be manipulated to rotate the operating rod. Since the hinged handle is disposed remote from the winding roller, it is hard for a force applied to the hinged handle to be transmitted to the rotation transmitting mechanism, thereby rendering operation of the operating rod laborious and inefficient.

In a co-pending U.S. patent application Ser. No. 13/036,066, entitled "Operating Device for Rotating a Winding Roller of a Window Blind," filed by the applicant, there is disclosed an upright rotating shaft which is operated to rotate by means of engagement between a sleeve shell and one of upper and lower coupling members.

It is desirable to improve the aforesaid operating device to simplify the structure thereof.

SUMMARY OF THE INVENTION

An object of the present invention is to provide an operating device which is operable easily and smoothly and which has a simple construction to facilitate manufacture.

According to this invention, the operating device includes a rotating shaft having a shaft end which is adapted to be coupled with a winding roller such that a rotation of the rotating shaft about an upright axis results in horizontal rotation of the winding roller for winding up or winding down a window covering, and a shaft body which extends from the shaft end along the upright axis and which has a thread segment formed on an outer shaft surface thereof. A sleeve shell is disposed to surround and permit the shaft body to be rotatable relative thereto so as to cooperatively define an accommodation space. The sleeve shell has a surrounding wall that extends in a direction of upright axis to terminate at first and second peripheral ends, and that includes first and second surrounding segments respectively proximate to the first and second peripheral ends. A carrier has an annular seat wall that surrounds the thread segment, and an actuated annular wall that surrounds the annular seat wall and that extends in the direction of upright axis to terminate at first and second actuated ends. The carrier is disposed in the accommodation space and is movable along the upright axis between a pressed position, where the first peripheral end is in pressing engagement with the first actuated end, and a non-pressed position, where the second actuated end rests on the second peripheral end. A force transmitting member is carried on the annular seat wall and is engaged with the thread segment. A rotation preventing unit is disposed between the first surrounding segment and the actuated annular wall such that, when the carrier is in the pressed position, an axially manual force applied to the surrounding wall is transmitted to move the actuated annular wall along the upright axis so as rotate the rotating shaft about the upright axis through engagement of the force transmitting member with the thread segment, thereby winding up the window covering.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
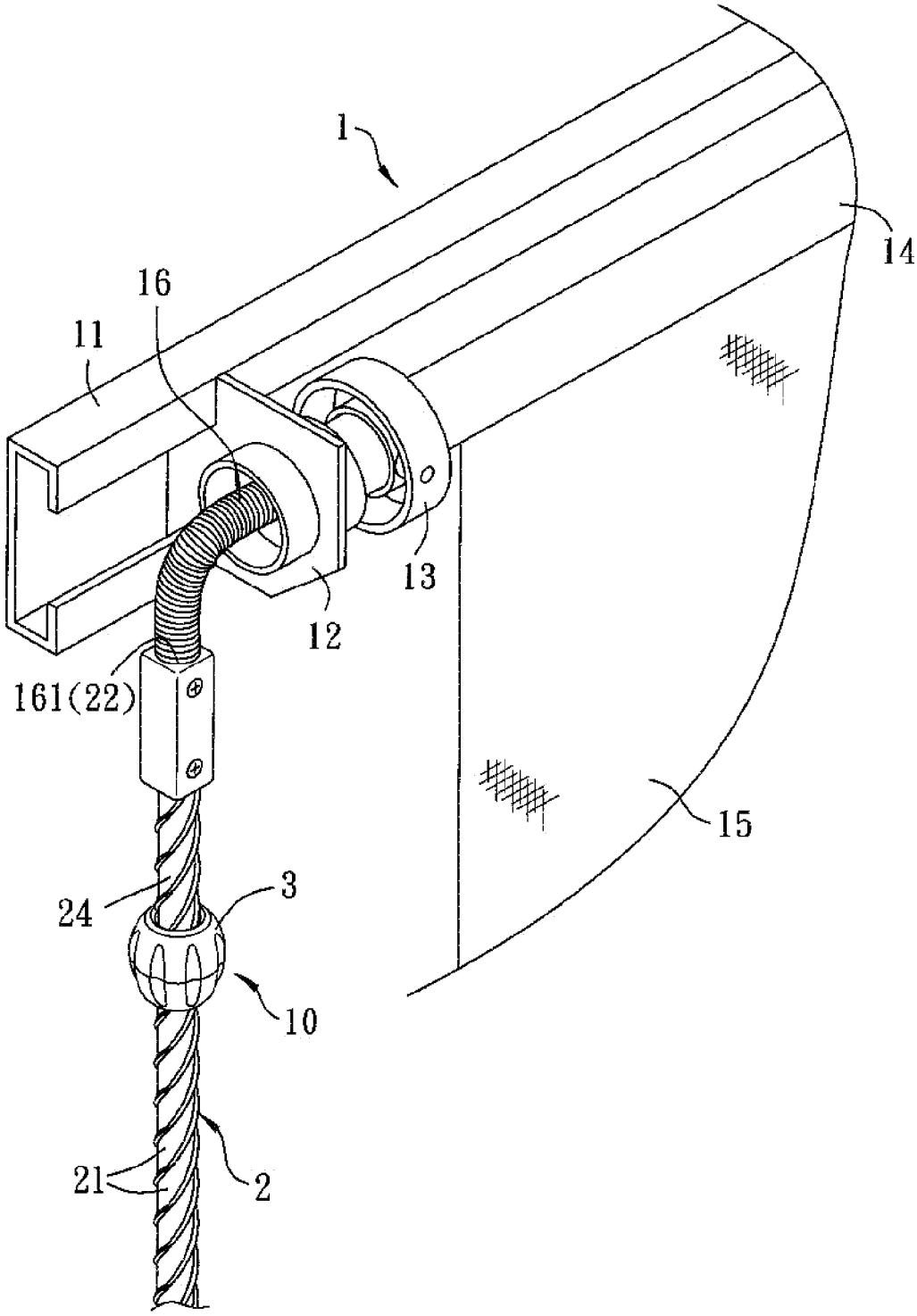
FIG. 1 is a fragmentary perspective view of the preferred embodiment of an operating device according to this invention incorporated in a window blind.
Figure 2:
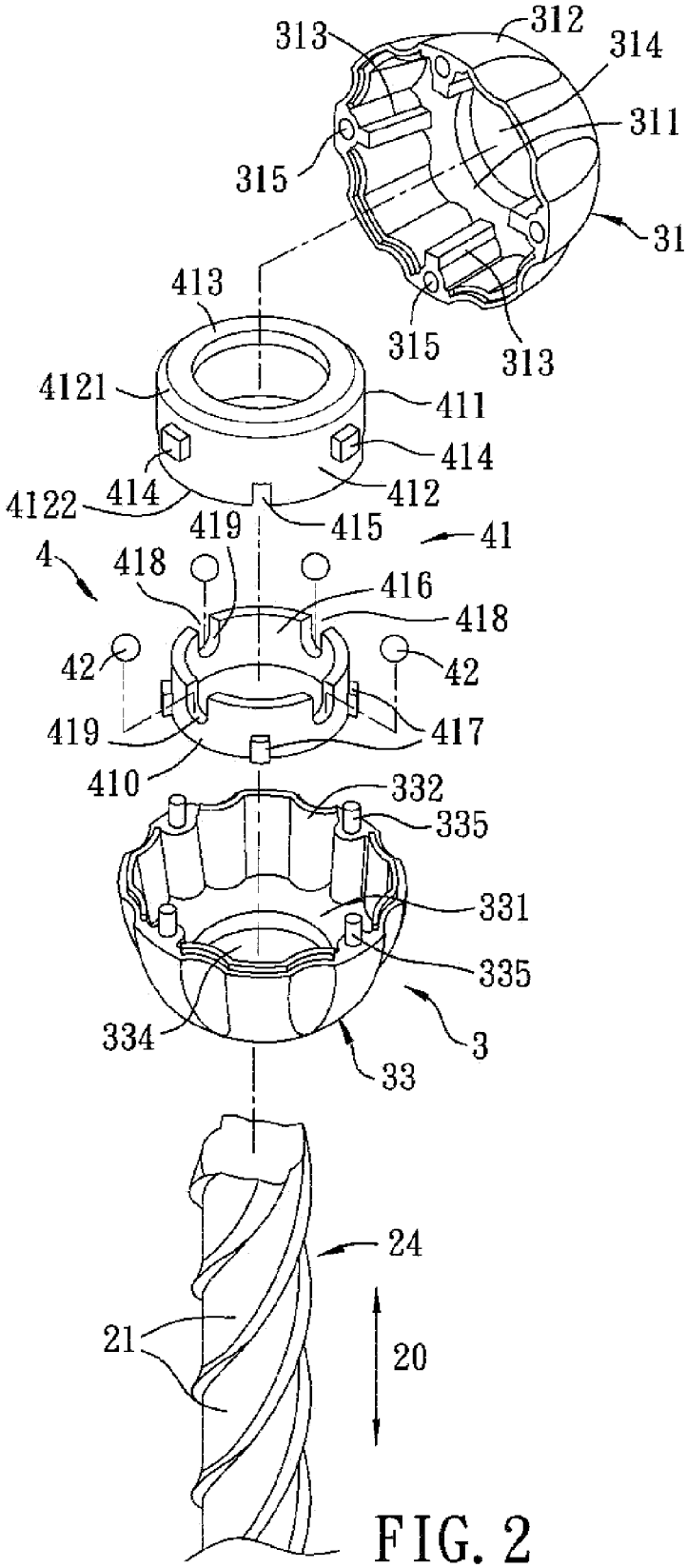
FIG. 2 is a fragmentary exploded perspective view of the preferred embodiment.
Figure 3:
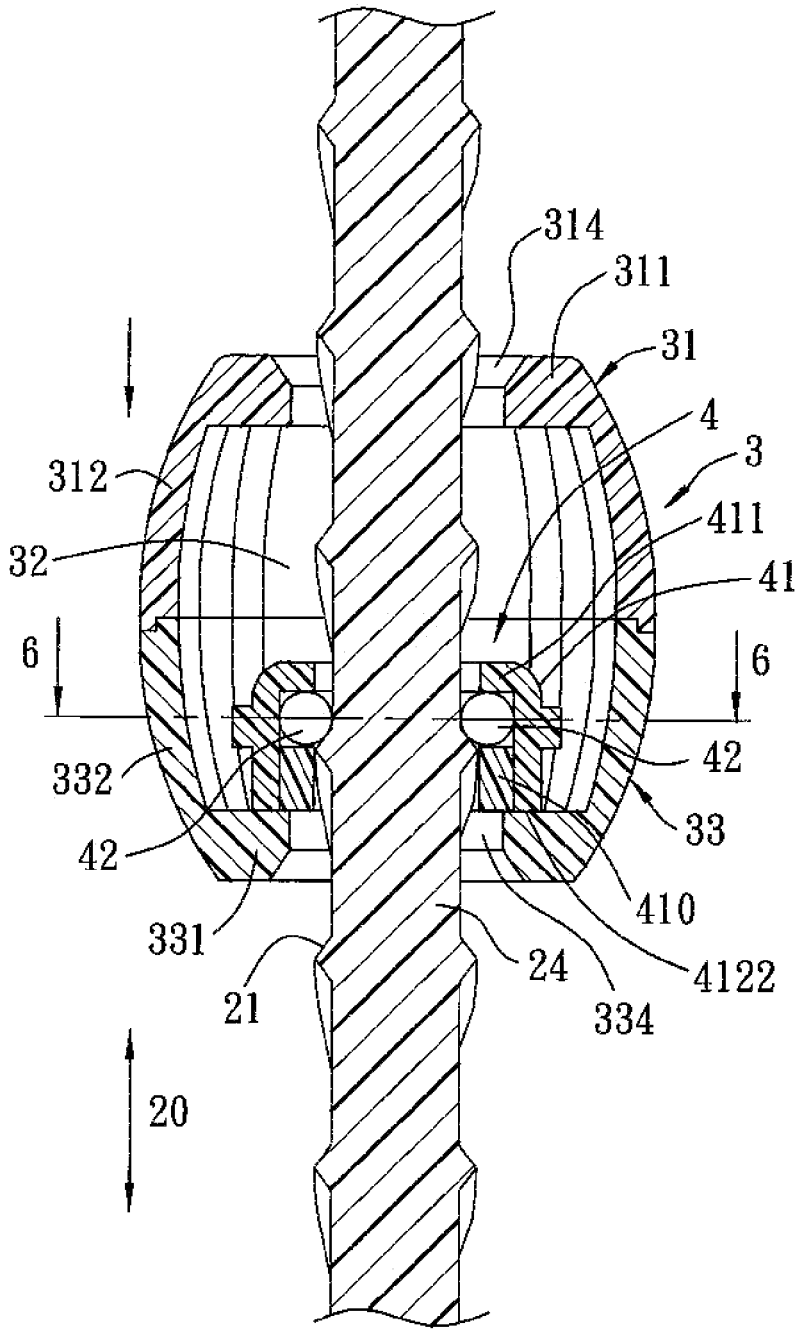
FIG. 3 is a fragmentary sectional view of the preferred embodiment when an actuating unit is in a non-pressed position.

Referring to FIGS. 1 to 3, the preferred embodiment of an operating device 10 according to the present invention is shown to be mounted on a window blind 1 for rotating a winding roller 14 of the window blind 1. The window blind 1 includes a horizontal extending headrail 11, two mounts 12 (only one is shown in FIG. 1) spacedly disposed on the headrail 11, two rotary sleeves 13 (only one is shown in FIG. 1) rotatably mounted between the mounts 12, the winding roller 14 operatively coupled with the rotary sleeves 13 to be rotatable relative to the headrail 11 about a horizontal axis for winding up or winding down a window covering 15, and a coupling mechanism 16 operatively coupled with one of the rotary sleeves 13, and having a connecting end 161. The operating device 10 of this invention is connected to the connecting end 161, and is shown to comprise a rotating shaft 2, a driving unit 3, an actuating unit 4, and a rotation preventing unit.

The rotating shaft 2 has a shaft end 22 which is adapted to be connected to the connecting end 161 of the coupling mechanism 16 such that a rotation of the rotating shaft 2 about an upright axis transverse to the horizontal axis results in a horizontal rotation of the winding roller 14, and a shaft body 24 which extends from the shaft end 22 along the upright axis and which has a thread segment 21 formed on an outer shaft surface thereof.

The driving unit 3 includes first and second shell halves 31, 33 which are engaged with each other by a spline structure, such as a plurality of axially extending holes and protrusions 315, 335 so as to cooperatively form a sleeve shell. The sleeve shell is disposed to surround and permit the shaft body 24 to be rotatable relative thereto so as to cooperatively define an accommodation space 32. The first and second shell halves 31, 33 respectively have first and second surrounding segments 312, 332 which cooperatively form a surrounding wall and which extend in a direction 20 of the upright axis to terminate at first and second peripheral ends 311, 331, respectively. The first and second shell halves 31, 33 respectively define first and second penetrating holes 314, 334 formed at the first and second peripheral ends 311, 331 for passage of the shaft body 24.

The actuating unit 4 is movably disposed in the accommodation space 32, and includes a carrier 41 and a plurality of force transmitting members 42.

The carrier 41 includes a bearing seat member 410 and an actuated cap member 411. The bearing seat member 410 has an annular seat wall 416 that surrounds the thread segment 21 and that has a plurality of bearing surfaces 419 angularly displaced from each other and facing upward to respectively form a plurality of recesses 418. The actuated cap member 411 has an actuated annular wall 412 which surrounds the annular seat wall 416 and which extends in the direction 20 of upright axis to terminate at first and second actuated ends 4121, 4122, and an inner flange 413 which extends inwardly and radially from the first actuated end 4121. The actuated annular wall 412 of the actuated cap member 411 is engaged with the annular seat wall 416 of the bearing seat member 410 by a spline structure, such as a plurality of recesses and protrusions 415, 417. The carrier 41 is movable along the upright axis between a pressed position (FIG. 4), where the first peripheral end 311 is in pressing engagement with the first actuated end 4121 and the inner flange 413, and a non-pressed position (FIG. 3) where the second actuated end 4122 rests on the second peripheral end 331.

The force transmitting members 42 are in the form of balls 42 which are received in the recesses 418, respectively, to be rotatably engaged on the bearing surfaces 419, respectively, which are held by the inner flange 413, and which are in rollable contact with the thread segment 21.

Alternatively, the force transmitting members 42 may integrally formed with the carrier 41.

Figure 4:
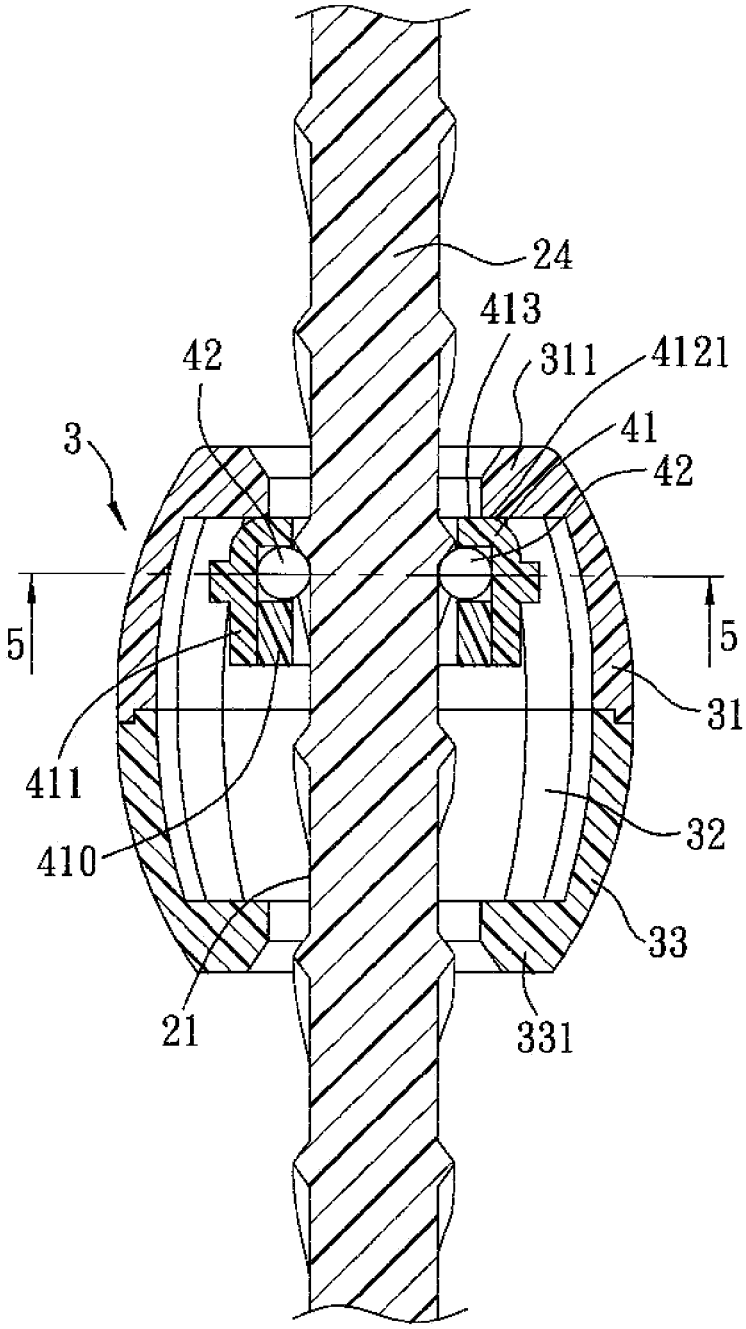
FIG. 4 is a fragmentary sectional view of the preferred embodiment when the actuating unit is in a pressed position.
Figure 5:
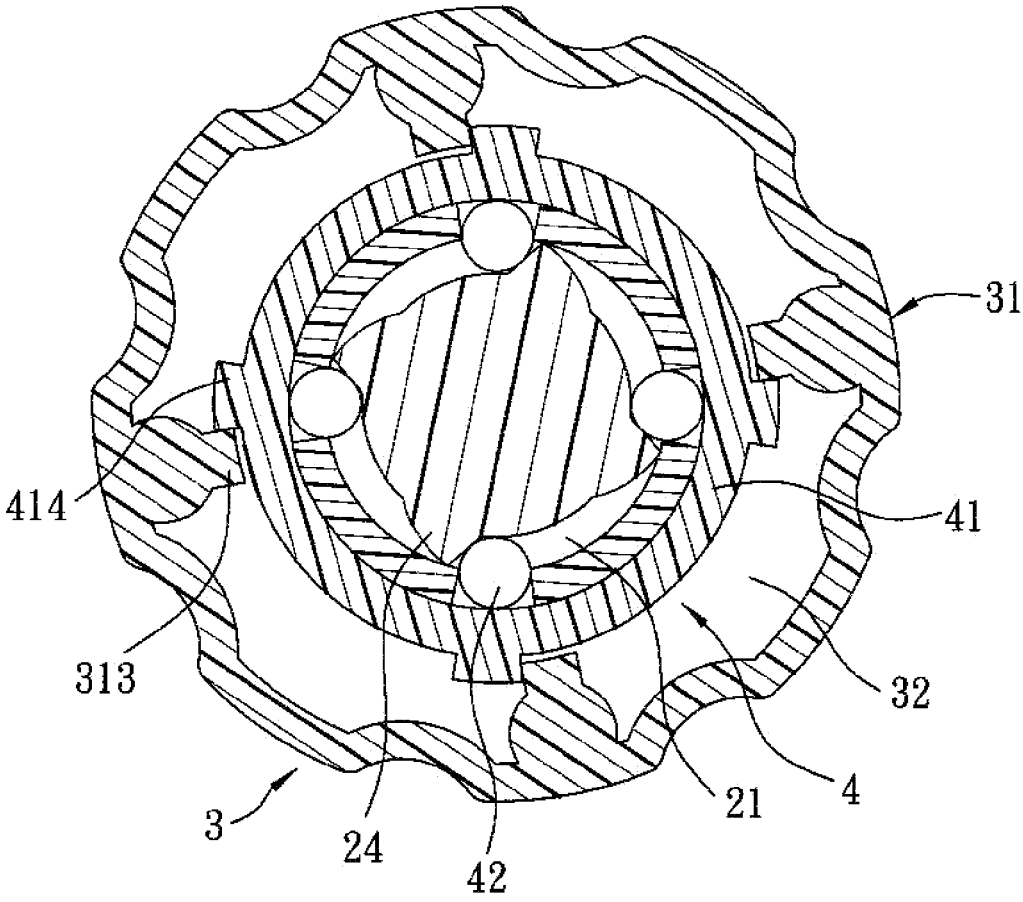
FIG. 5 is a cross-sectional view taken along line 5-5 of FIG. 4.

The rotation preventing unit includes a plurality of blocking bars 313 which project radially and inwardly from the first surrounding segment 312 of the first shell half 31 and which are angularly displaced from each other, and a plurality of blocked protrusions 414 which are configured to be engageable and blocked by the blocking bars 313 in a circumferential direction about the upright axis when the carrier 41 is in the pressed position, as shown in FIGS. 4 and 5.

Referring to FIGS. 3 to 5, when an axially manual force is applied to the driving unit 3, such as a downwardly pulling force, the sleeve shell is moved downwardly relative to the actuating unit 3 to the pressed position illustrated in FIG. 4. The downwardly pulling force is continued to apply to the driving unit 3 such that the actuating unit 4 is moved downward with the driving unit 3. In the meantime, by virtue of the rotation preventing unit which can prevent rotation of the carrier 41 relative to the sleeve shell, the downwardly pulling farce is transmitted to move the actuating unit 4 along the upright axis so as to spirally rotate the rotating shaft 2 in a clockwise direction about the upright axis through the engagement of the force transmitting members 42 with the thread segment 21, thereby winding up the window covering 15.

Figure 6:
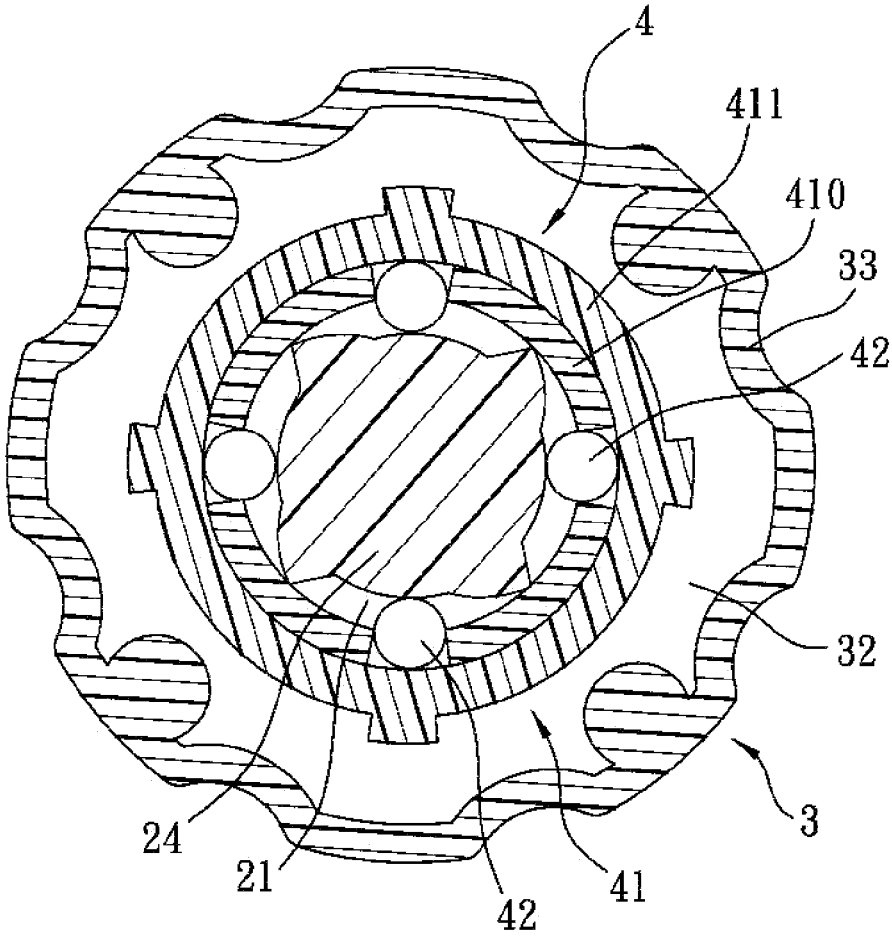
FIG. 6 is a cross-sectional view taken along line 6-6 of FIG. 3.

Referring to FIGS. 3, 4 and 6, once the driving unit 3 and the actuating unit 4 are lowered to reach a relatively lower position while the winding-up action of the window covering 15 has yet to be completed, an opposite axially manual force is applied to the driving unit 3, such as an upwardly lifting force, the sleeve shell is raised relative to the actuating unit 4 to the non-pressed position illustrated in FIG. 3. The upwardly lifting force is continued to apply to the driving unit 3 to move the actuating unit 4 upwardly with the driving unit 3 while leaving the rotating shaft 2 nonrotated because of the rollable contact of the force transmitting members 42 with the thread segment 21. When the driving unit 3 and the actuating unit 4 are raised to reach a relatively higher position, the downwardly pulling force is further applied to the driving unit 3 so as to move the actuating unit 4 to the pressed position for further rotating the rotating shaft 2.

When it is desired to wind down the window covering 15, the rotating shaft 2 is rotated manually in a counterclockwise direction about the upright axis. By the weight of the window covering 15, the user can rotate the rotating shaft 2 in the counterclockwise direction effortlessly.

Accordingly, the operating device of the embodiment has a simple construction, and is operable conveniently and effortlessly, particularly being used for winding a relatively long window covering.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A window blind assembly, comprising:

a headrail;

a winding roller rotatable relative to said headrail about a horizontal axis for winding up or winding down a window covering;

a rotating shaft having a shaft end which is adapted to be coupled with the winding roller such that a rotation of said rotating shaft about an upright axis transverse to the horizontal axis results in horizontal rotation of the winding roller, and a shaft body which extends from said shaft end along the upright axis and which has a thread segment formed on an outer shaft surface thereof;

a sleeve shell which is disposed to surround and permit said shaft body to be rotatable relative thereto so as to cooperatively define an accommodation space, and which has a surrounding wall that extends in a direction of upright axis to terminate at first and second peripheral ends, and that includes first and second surrounding segments respectively proximate to said first and second peripheral ends;

a carrier which has an annular seat wall that surrounds said thread segment, and an actuated annular wall that surrounds said annular seat wall and that extends in the direction of upright axis to terminate at first and second actuated ends, said carrier being disposed in said accommodation space and movable along the upright axis between a pressed position, where said first peripheral end is in pressing engagement with said first actuated end, and a non-pressed position, where said second actuated end rests on said second peripheral end;

a force transmitting member which is carried on said annular seat wall and which is engaged with said thread segment; and a rotation preventing unit disposed between said first surrounding segment and said actuated annular wall such that, when said carrier is in the pressed position, an axially manual force applied to said surrounding wall is transmitted to move said actuated annular wall along the upright axis so as to rotate said rotating shaft about the upright axis through engagement of said force transmitting member with said thread segment, thereby winding up the window covering.

2. The window blind assembly according to claim 1, wherein said force transmitting member is rotatably carried on said annular seat wall to be in rollable contact with said thread segment.

3. An operating device for rotating a winding roller of a window blind, the winding roller being rotatable relative to a headrail about a horizontal axis for winding up or winding down a window covering, said operating device comprising:

a rotating shaft having a shaft end which is adapted to be coupled with the winding roller such that a rotation of said rotating shaft about an upright axis transverse to the horizontal axis results in horizontal rotation of the winding roller, and a shaft body which extends from said shaft end along the upright axis and which has a thread segment formed on an outer shaft surface thereof;

a sleeve shell which is disposed to surround and permit said shaft body to be rotatable relative thereto so as to cooperatively define an accommodation space, and which has a surrounding wall that extends in a direction of upright axis to terminate at first and second peripheral ends, and that includes first and second surrounding segments respectively proximate to said first and second peripheral ends;

a carrier which has an annular seat wall that surrounds said thread segment, and an actuated annular wall that surrounds said annular seat wall and that extends in the direction of upright axis to terminate at first and second actuated ends, said carrier being disposed in said accommodation space and movable along the upright axis between a pressed position, where said first peripheral end is in pressing engagement with said first actuated end, and a non-pressed position, where said second actuated end rests on said second peripheral end;

a force transmitting member which is carried on said annular seat wall and which is engaged with said thread segment; and a rotation preventing unit disposed between said first surrounding segment and said actuated annular wall such that, when said carrier is in the pressed position, an axially manual force applied to said surrounding wall is transmitted to move said actuated annular wall along the upright axis so as to rotate said rotating shaft about the upright axis through engagement of said force transmitting member with said thread segment, thereby winding up the window covering, wherein said force transmitting member is rotatably carried on said annular seat wall to be in rollable contact with said thread segment, and wherein said carrier includes a bearing seat member which has said annular seat wall that has a bearing surface facing upward to permit said force transmitting member to be rotatably engaged thereon, and an actuated cap member which has said actuated annular wall and an inner flange that extends inwardly and radially from said first actuated end, that confronts said bearing surface to hold said force transmitting member, and that abuts against said first peripheral end to transmit the axially manual force to said force transmitting member.

4. The operating device according to claim 3, wherein said rotation preventing unit includes a plurality of blocking bars projecting radially and inwardly from said first surrounding segment, and a plurality of blocked protrusions configured to be engageable and blocked by said blocking bars, respectively, in a circumferential direction about the upright axis so as to prevent rotation of said carrier relative to said sleeve shell when the manually axial force is applied to said surrounding wall, thereby making a spiral rotation of said thread segment about the upright axis.

5. The operating device according to claim 3, wherein said actuated annular wall of said actuated cap member is engaged with said annular seat wall of said bearing seat member by a spline structure.

6. The operating device according to claim 3, wherein said sleeve shell includes first and second shell halves which respectively have said first and second surrounding segments and which are engaged with each other by a spline structure.

7. The operating device according to claim 6, wherein said first and second shell halves respectively define first and second penetrating holes formed at said first and second peripheral ends for passage of said shaft body.

* * * * *